US010923808B2

(12) United States Patent
Xu et al.

(10) Patent No.: US 10,923,808 B2
(45) Date of Patent: Feb. 16, 2021

(54) ANTENNA SYSTEM

(71) Applicant: HUAWEI TECHNOLOGIES CO., LTD., Guangdong (CN)

(72) Inventors: Su Xu, Shenzhen (CN); Huailin Wen, Ottawa (CA)

(73) Assignee: HUAWEI TECHNOLOGIES CO., LTD., Guangdong (CN)

( * ) Notice: Subject to any disclaimer, the term of this patent is extended or adjusted under 35 U.S.C. 154(b) by 72 days.

(21) Appl. No.: 16/265,277

(22) Filed: Feb. 1, 2019

(65) Prior Publication Data

US 2019/0165466 A1 May 30, 2019

Related U.S. Application Data

(63) Continuation of application No. PCT/CN2017/090404, filed on Jun. 27, 2017.

(30) Foreign Application Priority Data

Aug. 8, 2016 (CN) ..... 2016 1 0645845

(51) Int. Cl.
*H01Q 21/00* (2006.01)
*H01Q 1/52* (2006.01)
(Continued)

(52) U.S. Cl.
CPC ..... *H01Q 1/521* (2013.01); *H01Q 1/38* (2013.01); *H01Q 1/48* (2013.01); *H01Q 9/0421* (2013.01);
(Continued)

(58) Field of Classification Search
CPC .. H01Q 1/521; H01Q 15/006; H01Q 15/0006; H01Q 9/42; H01Q 21/28;
(Continued)

(56) References Cited

U.S. PATENT DOCUMENTS

2002/0113737 A1 8/2002 Brachat et al.
2008/0074341 A1* 3/2008 Chung ..... H01Q 7/00 343/841
(Continued)

FOREIGN PATENT DOCUMENTS

CN 1390373 A 1/2003
CN 103326122 A 9/2013
(Continued)

OTHER PUBLICATIONS

Abdolmehdi Dadgarpour et al. "Mutual-Coupling suppression for 60 GHz MIMO Antenna using Metamaterials" 2015 IEEE, total 2 pages.
(Continued)

*Primary Examiner* — Dieu Hien T Duong
(74) *Attorney, Agent, or Firm* — Womble Bond Dickinson (US) LLP

(57) ABSTRACT

This application discloses an antenna system, includes: a ground plate, at least one antenna pair disposed on the ground plate, and a decoupling assembly disposed on a radiation surface of the antenna pair; where the antenna pair includes a first antenna and a second antenna; the decoupling assembly is configured to adjust antenna radiation directions of the first antenna and the second antenna. In this application, the following problem is resolved: A poor effect is achieved when coupling between antennas is reduced by using a slit because there are many electronic elements in a mobile terminal and the slit is easily affected by surrounding electronic elements. Antenna radiation directions of the antennas are changed by using the decoupling assembly disposed on the radiation surface of the antenna pair, thereby improving isolation between the antennas and antenna radiation efficiency.

11 Claims, 13 Drawing Sheets

(51) Int. Cl.

| | |
|---|---|
| ***H01Q 21/28*** | (2006.01) |
| ***H01Q 9/42*** | (2006.01) |
| ***H01Q 15/00*** | (2006.01) |
| ***H01Q 1/38*** | (2006.01) |
| ***H01Q 1/48*** | (2006.01) |
| ***H01Q 9/04*** | (2006.01) |
| *H01Q 1/24* | (2006.01) |

(52) U.S. Cl.
CPC ..... *H01Q 9/42* (2013.01); *H01Q 15/0006* (2013.01); *H01Q 15/006* (2013.01); *H01Q 21/28* (2013.01); *H01Q 1/243* (2013.01)

(58) Field of Classification Search
CPC ..... H01Q 9/0421; H01Q 1/48; H01Q 1/38; H01Q 1/243; H01Q 21/00; H01Q 3/00; H01Q 1/52; H01Q 1/36
See application file for complete search history.

(56) References Cited

U.S. PATENT DOCUMENTS

| | | | | |
|---|---|---|---|---|
| 2009/0040114 | A1* | 2/2009 | Okamura | H01Q 1/2266 343/700 MS |
| 2010/0073232 | A1* | 3/2010 | Sajuyigbe | H01Q 15/006 342/372 |
| 2017/0222331 | A1* | 8/2017 | Pance | H01Q 21/28 |

FOREIGN PATENT DOCUMENTS

| | | | |
|---|---|---|---|
| CN | 203800171 | U | 8/2014 |
| CN | 205029016 | U | 2/2016 |
| CN | 105633574 | A | 6/2016 |
| EP | 1195847 | A2 | 4/2002 |

OTHER PUBLICATIONS

Ferrer, Pere J. et al. "Bidirectional Metamaterial Separator for Compact Antenna Systems" 2007 IEEE Antennas and Propagation Society International Symposium, Jun. 9-15, 2007, total 4 pages.

Imbert, Marc et al. "Assessment of the Performance of a Metamaterial Spacer in a Closely Spaced Multiple-Antenna System" IEEE Antennas and Wireless Propagation Letters, vol. 11, 2012, total 4 pages.

International Search Report dated Aug. 8, 2017 in corresponding International Patent Application No. PCT/CN2017/090404 (7 pages).

Written Opinion of the International Searching Authority dated Aug. 9, 2017 in corresponding International Patent Application No. PCT/CN2017/090404 (4 pages).

International Search Report dated Aug. 8, 2017 in corresponding International Application No. PCT/CN2017/090404.

Shuai Zhang et al.,Ultrawideband MIMO/Diversity Antennas With a Tree-Like Structure to Enhance Wideband Isolation, IEEE Antennas and Wireless Propagation Letters, IEEE Antennas and Wireless Propagation Letters, vol. 8, 2009, pp. 1279-1282.

Cesar Roman Garcia et al: "3D printed spatially variant anisotropic metamaterials", May 2014, XP055526246.

Saenz E et al: "Coupling Reduction Between Dipole Antenna Elements by Using a Planar Meta-Surface", IEEE Trans on Antenn and Propag, vol. 57, No. 2, pp. 383-394, Feb. 2009, XP011254037.

Shuai Zhang et al: "Ultrawideband MIMO/Diversity Antennas With a Tree-Like Structure to Enhance Wideband Isolation", IEEE Antennas and Wireless Propagation Letters, vol. 8, pp. 1279-1282, Nov. 24, 2009. XP011331166.

Su Xu et al: "Realization of deep subwavelength resolution with singular media", Scientific Reports, vol. 4, No. 1, Jun. 9, 2014, XP055600906.

Zhao Luyu et al: "A Decoupling Technique for Four-Element Symmetric Arrays With Reactively Loaded Dummy Elements",IEEE Transactions 0n Antennas and Propagation, IEEE Service Center, vol. 62, No. 8, Aug. 1, 2014, pp. 4416-4421, XP011555309.

* cited by examiner

| | Before a decoupling assembly is disposed | After a decoupling assembly is disposed |
|---|---|---|
| $k$ surface | (a)   | (c)   |
| Virtual space | (b)   | (d)   |

ANTENNA SYSTEM

CROSS-REFERENCE TO RELATED APPLICATIONS

This application is a continuation of International Application No. PCT/CN2017/090404, filed on Jun. 27, 2017, which claims priority to Chinese Patent Application No. 201610645845.5, filed on Aug. 8, 2016. The disclosures of the aforementioned applications are hereby incorporated by reference in their entireties.

TECHNICAL FIELD

Embodiments of this application relate to the antenna field, and especially, to an antenna system.

BACKGROUND

A multiple-input multiple-output (MIMO) antenna technology is one of core technologies in the wireless communications field, and is used to improve a signal throughput rate of a terminal.

A terminal that uses the MIMO antenna technology receives signals by using a plurality of receive antennas, and transmits signals by using a plurality of transmit antennas, to improve a signal throughput rate of the terminal without increasing a spectrum resource and antenna transmit power. When the MIMO antenna technology is applied to a mobile terminal such as a smartphone or a tablet computer, a plurality of antennas are centrally disposed in a relatively small area due to a limited size of the mobile terminal, thereby resulting in relatively strong coupling between antennas, and affecting antenna transmit efficiency.

In a related technology, to reduce coupling between antennas in a mobile terminal, a slit is disposed on a ground plate between the antennas, and distribution of a coupling current on the ground plate is changed by using the slit, to reduce the coupling between the antennas, and improve isolation between the antennas.

However, a poor effect is achieved when coupling is reduced by using the slit because there are many electronic elements in the mobile terminal and the slit is easily affected by surrounding electronic elements.

SUMMARY

Embodiments of this application provide an antenna system, to resolve a problem that a poor effect is achieved when coupling between antennas is reduced by using a slit because there are many electronic elements in a mobile terminal and the slit is easily affected by surrounding electronic elements. A technical solution is as follows:

According to a first aspect, an antenna system is provided, and the antenna system includes:

a ground plate, at least one antenna pair disposed on the ground plate, and a decoupling assembly disposed on a radiation surface of the antenna pair, where the antenna pair includes a first antenna and a second antenna;

the decoupling assembly has electrical anisotropy, and the electrical anisotropy indicates that an effective permittivity of the decoupling assembly has different components in different directions;

the decoupling assembly is configured to adjust antenna radiation directions of the first antenna and the second antenna; and isolation between the first antenna and the second antenna after adjustment is greater than isolation between the first antenna and the second antenna before adjustment.

The decoupling assembly having the electrical anisotropy is disposed on the radiation surface of the antenna pair, and the antenna radiation direction of each of the first antenna and the second antenna in the antenna pair is changed by using this decoupling structure, to improve isolation between the first antenna and the second antenna when the first antenna and the second antenna are relatively close to each other, and reduce coupling between the first antenna and the second antenna, thereby improving antenna radiation efficiency of the antenna system.

With reference to the first aspect, in a first possible implementation of the first aspect, the decoupling assembly is in a laminated structure;

the laminated structure is formed by alternately stacking at least two materials, and permittivities of the at least two materials are different; and a sum of thicknesses of the at least two materials is less than a half wavelength corresponding to an operating frequency of the antenna pair, where $|\varepsilon_\perp| \ll |\varepsilon_\parallel|$, $\varepsilon_\perp$ is an effective permittivity of the laminated structure in a perpendicular direction, $\varepsilon_\parallel$ is an effective permittivity of the laminated structure in a parallel direction, the parallel direction is a direction parallel to the laminated structure, and the perpendicular direction is a direction perpendicular to the laminated structure.

In a laminated structure formed by alternately stacking two materials with different permittivities, an effective permittivity of the laminated structure in a parallel direction is greater than an effective permittivity of the laminated structure in a perpendicular direction. Therefore, the antenna radiation directions of the first antenna and the second antenna in the antenna pair can be limited in the laminated structure, so that isolation between the antennas is improved, and an antenna decoupling effect is achieved.

With reference to the first possible implementation of the first aspect, in a second possible implementation of the first aspect, the laminated structure is formed by alternately stacking a first material and a second material;

the first material is a good-conductor material; and the second material is a dielectric material, where $|\varepsilon_1| \gg |\varepsilon_2|$ and $|\varepsilon_\perp| \ll |\varepsilon_\parallel|$, $\varepsilon_1$ is a permittivity of the first material, and $\varepsilon_2$ is a permittivity of the second material.

In the laminated structure formed by alternately stacking the good-conductor material and the dielectric material that differ relatively greatly in permittivity, the effective permittivity of the laminated structure in the parallel direction is far greater than the effective permittivity of the laminated structure in the perpendicular direction. Therefore, a better limitation effect can be achieved in an antenna radiation direction by using the laminated structure, and isolation between the antennas in the antenna system is further improved.

With reference to the first possible implementation of the first aspect or the second possible implementation of the first aspect, in a third possible implementation of the first aspect, the decoupling assembly includes two decoupling subassemblies that are symmetrically disposed, and the two decoupling subassemblies are respectively disposed on radiation surfaces of the first antenna and the second antenna; and an included angle $\alpha$ is formed between the laminated structure and the ground plate, where $10° \leq \alpha \leq 60°$.

There is a specific included angle between the laminated structure of the decoupling assembly and the ground plate.

The antenna radiation directions of the first antenna and the second antenna can be changed by changing a magnitude of the included angle, thereby improving applicability of the antenna system.

With reference to the first aspect, the first possible implementation of the first aspect, the second possible implementation of the first aspect, or the third possible implementation of the first aspect, in a fourth possible implementation of the first aspect, a metallic wire is disposed between the first antenna and the second antenna, the metallic wire penetrates the ground plate, and the metallic wire is used to reduce interference caused by a scattered electromagnetic wave in the ground plate to the first antenna and the second antenna.

The interference caused by the scattered electromagnetic wave in the ground plate to the first antenna and the second antenna is reduced by using the metallic wire disposed between the first antenna and the second antenna, so that current coupling between the antennas is reduced, isolation between the antennas is further improved, and a better antenna decoupling effect is achieved.

With reference to the first aspect, the first possible implementation of the first aspect, the second possible implementation of the first aspect, or the third possible implementation of the first aspect, in a fifth possible implementation of the first aspect, an insulation layer is disposed between the decoupling assembly and the antenna pair.

The insulation layer is disposed between the decoupling assembly and the antenna pair, so that a current between the antenna pair and the decoupling assembly is isolated, and a short circuit caused when a feeding current flows through the antenna pair into a decoupling structure is avoided.

With reference to the third possible implementation of the first aspect, the fourth possible implementation of the first aspect, or the fifth possible implementation of the first aspect, in a sixth possible implementation of the first aspect, the decoupling subassembly is in a triangular prism laminated structure;

a dimension of the triangular prism laminated structure is 10 mm×5 mm×4 mm;

the triangular prism laminated structure is formed by alternately stacking a metal film and a dielectric sheet;

an included angle $\alpha$ between the triangular prism laminated structure and the ground plate is 22.6°; and the dielectric sheet in the triangular prism laminated structure is 1 mm in thickness, and a relative permittivity of the dielectric sheet is 1.1.

With reference to the sixth possible implementation of the first aspect, in a seventh possible implementation of the first aspect, the antenna pair is a helical monopole antenna pair, and the helical monopole antenna pair is printed on a surface of the ground plate;

a dimension of the helical monopole antenna pair is 22 mm×5 mm;

dimensions of the first antenna and the second antenna in the helical monopole antenna pair each are 10.6 mm×5 mm, and a distance between a first antenna feeding point and a second antenna feeding point is 0.8 mm; and an operating frequency of the helical monopole antenna pair ranges from 4.55 GHz to 4.75 GHz.

With reference to the sixth possible implementation of the first aspect, in an eighth possible implementation of the first aspect, the antenna pair is a planar inverted F antenna (PIFA) antenna pair, and the PIFA antenna pair is printed on a surface of the ground plate;

a dimension of the PIFA antenna pair is 22 mm×5 mm;

dimensions of the first antenna and the second antenna in the PIFA antenna pair each are 10 mm×5 mm, a distance between a first antenna feeding point and a second antenna feeding point is 5 mm, and a distance between a first antenna ground point and a second antenna ground point is 2 mm; and an operating frequency of the PIFA antenna pair ranges from 2.3 GHz to 2.4 GHz.

With reference to the sixth possible implementation of the first aspect, in a ninth possible implementation of the first aspect, the antenna pair is a PIFA antenna pair, and the PIFA antenna pair is printed on a surface of the ground plate;

a dimension of the PIFA antenna pair is 15 mm×5 mm;

dimensions of the first antenna and the second antenna in the PIFA antenna pair each are 6.5 mm×5 mm, a distance between a first antenna feeding point and a second antenna feeding point is 5 mm, and a distance between a first antenna ground point and a second antenna ground point is 2 mm; and an operating frequency of the PIFA antenna pair ranges from 3.4 GHz to 3.6 GHz.

In this embodiment, the decoupling assembly has high applicability, and antenna decoupling may be performed on different types of antenna pairs (such as the helical monopole antenna pair or the PIFA antenna pair) at different operating frequencies (such as 4.55 GHz to 4.75 GHz, 2.3 GHz to 2.4 GHz, or 3.4 GHz to 3.6 GHz) by using decoupling assemblies of a same dimension, and the decoupling assembly does not need to be redesigned.

With reference to the seventh possible implementation of the first aspect, in a tenth possible implementation of the first aspect, a dimension of the ground plate is 136 mm×68 mm, and 12 helical monopole antenna pairs are disposed on an edge of the ground plate;

two helical monopole antenna pairs are disposed on each of an upper edge and a lower edge of the ground plate;

four helical monopole antenna pairs are disposed on each of a left edge and a right edge of the ground plate; and a distance between the helical monopole antenna pairs is greater than 8 mm.

For a terminal of a relatively small size, a plurality of antenna pairs are disposed on a peripheral side of the ground plate at intervals, and the decoupling assembly is disposed on a radiation surface of each antenna pair, so that isolation between antennas in the antenna pair and isolation between the antenna pairs are improved, and efficiency of a MIMO antenna in the small-sized terminal is improved.

DESCRIPTION OF EMBODIMENTS

Figure 1:
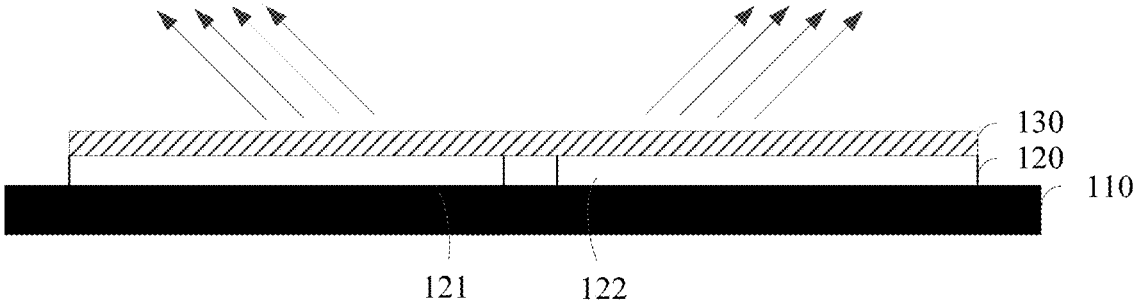
FIG. 1 is a schematic structural diagram of an antenna system according to an embodiment of this application.

To make the objectives, technical solutions, and advantages of this application clearer, the following further describes the implementations of this application in detail with reference to the accompanying drawings.

For ease of understanding, the following explains terms in embodiments of this application.

Anisotropy: indicates that a value of a constitutive parameter of a substance that propagates an electromagnetic field has different components in different directions. Specifically, the anisotropy may include electrical anisotropy (a permittivity has different components in different directions), magnetic anisotropy (magnetic permeability has different components in different directions), and bianisotropy (a permittivity and magnetic permeability each have different components in different directions). It should be noted that the "different components" mentioned herein means that components are different in at least two directions, but does not specifically mean that components in all directions are different from each other.

Similarly, isotropy indicates that a value of a constitutive parameter of a substance that propagates an electromagnetic field has a same component in different directions. For example, vacuum is usually characterized by isotropy.

Equivalent parameter: A new electromagnetic material is formed by combining a plurality of element structures. If the element structure in the new electromagnetic material is considered as a molecule or an atom, the new electromagnetic material may be equivalent to a uniform medium with a special electromagnetic property, and the electromagnetic property of the new electromagnetic material may be represented by the equivalent parameter. The equivalent parameter in the embodiments of this application includes an effective permittivity, and the effective permittivity is used to represent a permittivity of a decoupling assembly.

Relative permittivity: When a medium is in an applied electric field, an induced charge is generated and an electric field is weakened, and a ratio of the original applied electric field (in vacuum) to the electric field in the medium is the relative permittivity. A permittivity is a product of the relative permittivity and an absolute permittivity in vacuum, for example, $\varepsilon=\varepsilon_r*\varepsilon_0$, where $\varepsilon_r$ is the relative permittivity, $\varepsilon_0$ is the absolute permittivity in vacuum, and $\varepsilon_0=8.85*10^{(-12)}$ F/m.

Subwavelength: used to indicate a distance or a scale less than a free space wavelength of a frequency. For example, when the frequency is 1 GHz, the free space wavelength is 300 mm, and the subwavelength is a distance less than 300 mm.

Deep subwavelength: a type of subwavelength, used to indicate a distance or a scale less than 0.1 wavelength.

k surface: a representation form of a dispersion curve, used to represent a feature of an electromagnetic wave vector in space.

Virtual space: equivalent space for propagating an electromagnetic wave on which transformation optics design is performed.

When a correlation between antennas is relatively low (a distance between the antennas is required to be greater than a half wavelength of an operating frequency), a throughput rate of an antenna system exponentially increases with a quantity of antennas. When a MIMO antenna technology is applied to a mobile terminal, the distance between the antennas is far less than the half wavelength of the operating frequency due to a limited size of the mobile terminal, thereby resulting in a relatively high correlation and relatively low isolation between the antennas, resulting in severe coupling between the antennas, and affecting efficiency of the antenna system.

To improve isolation between antennas in a mobile terminal and reduce coupling between the antennas, in an antenna system, a developer disposes a slit on a ground plate between the antennas, and changes distribution of a coupling current on the ground plate by using the slit, to reduce current coupling between the antennas, and improve the isolation between the antennas. However, a poor effect is achieved when coupling is reduced by using the slit because there are many electronic elements in the mobile terminal and the slit is easily affected by surrounding electronic elements.

In another antenna system, the developer further disposes a microstrip band-stop filter on the ground plate, neutralizes the coupling current between the antennas by using a neutralization line disposed between the antennas, and adds an inductor-capacitor (LCt) decoupling circuit or the like, to reduce the coupling between the antennas. However, this type of method can only be used to decouple antennas on a specific operating frequency band to implement narrowband decoupling, but cannot be applied to multiband or broadband decoupling.

In the antenna system provided in the embodiments of this application, a decoupling assembly is disposed on a radiation surface of an antenna, and an antenna radiation direction of the antenna is adjusted by using the decoupling assembly, so that isolation between antennas is improved, and coupling between the antennas is reduced. Descriptions are provided below by using example embodiments.

FIG. 1 is a schematic structural diagram of an antenna system according to an embodiment of this application. The antenna system includes a ground plate 110, at least one antenna pair 120 disposed on the ground plate, and a decoupling assembly 130 disposed on a radiation surface of the antenna pair 120.

As shown in FIG. 1, the antenna pair 120 includes a first antenna 121 and a second antenna 122, and a distance between the first antenna 121 and the second antenna 122 meets a subwavelength. For example, when an operating frequency of the antenna pair 120 is 3 GHz, the distance between the first antenna 121 and the second antenna 122 is less than 100 mm. In this embodiment, the first antenna 121 and the second antenna 122 may be symmetrically disposed antennas; in other words, the first antenna 121 and the second antenna 122 have a same antenna type, dimension, and operating frequency. The first antenna 121 and the second antenna 122 may alternatively have a same antenna type, but have different dimensions and operating frequencies, or have different antenna types, dimensions, and operating frequencies. This is not limited in this embodiment.

The decoupling assembly 130 is disposed above radiation surfaces of the first antenna 121 and the second antenna 122. The radiation surface of the antenna (pair) is an antenna surface used to radiate an antenna signal. In a possible implementation, when the antenna is a printed antenna, the radiation surface of the antenna is an antenna plane exposed on a surface of the ground plate 110. It should be noted that in another possible implementation, when the antenna is a stereoscopic antenna of a specific height, the radiation surface of the antenna is an antenna plane with a largest amount of antenna signal radiation. It should be noted that in this embodiment, an antenna type of the antenna pair 120 may be a PIFA antenna, a planar inverted L antenna (PILA), an inverted F antenna (IFA), an inverted L antenna (ILA), a monopole antenna (antenna), a loop antenna, or the like. The antenna type is not limited in this application.

The decoupling assembly 130 disposed on the antenna pair 120 has electrical anisotropy, and the electrical anisotropy indicates that an effective permittivity of the decoupling assembly 130 has different components in different directions. Based on this feature, the decoupling assembly can adjust antenna radiation directions of the first antenna 121 and the second antenna 122, so that isolation between the first antenna 121 and the second antenna 122 after adjustment is greater than isolation between the first antenna 121 and the second antenna 122 before adjustment.

From the perspective of principles of physics, the antenna pair 120 and the decoupling assembly 130 may be considered as a subwavelength optical imaging system. The first antenna 121 and the second antenna 122 in the antenna pair 120 may be considered as two point sources (light sources) with a subwavelength distance, and the decoupling assembly 130 may be considered as a lens disposed above the point sources. The lens is configured to overcome diffraction limits of the two light sources with the subwavelength distance. From the perspective of a field, the lens can change diffraction directions of the point sources, and improve directionality of the diffraction directions. When this case is mapped to the antenna field, it is equivalent to changing the antenna radiation directions of the antennas, improving directionality of the antenna radiation directions and isolation between the antennas, and reducing antenna coupling between the two antennas.

The decoupling assembly can change the antenna radiation directions of the antennas because a decoupling structure has the electrical anisotropy. Because an effective permittivity of the decoupling structure has different components in different directions, an antenna radiation electric field has different wave vectors (a method for representing a vector of a wave, used to indicate a wave propagation direction) in different directions; in other words, the antenna radiation electric field has different radiation degrees in the different directions. The antenna radiation directions can be adjusted by controlling the wave vectors.

Figure 2:
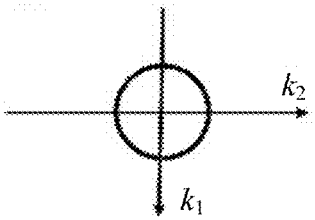
FIG. 2 is a schematic diagram of radiation of an antenna signal before and after a decoupling assembly is disposed.
Figure 2:
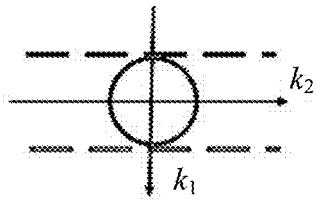
Figure 2:
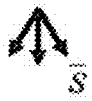
Figure 2:
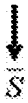

As shown in FIG. 2(*a*), before a decoupling assembly is disposed, a substance located on a radiation surface of an antenna is air (free space). Because it is equally difficult to radiate an antenna signal in all directions of the free space, a k surface of the antenna signal is circular in a plane. Correspondingly, as shown in FIG. 2(*b*), virtual space in the free space is an area with an unlimited width, and therefore the antenna can radiate antenna signals in different directions. However, a distance between antennas is extremely small (reaching a deep subwavelength), and there is an intersection (near an axis of symmetry between the first antenna 121 and the second antenna 122 in FIG. 1) between antenna radiation patterns respectively corresponding to the first antenna and the second antenna, thereby resulting in severe coupling between antenna signals, and affecting radiation efficiency of the antenna system.

As shown in FIG. 2(*c*), after a decoupling assembly is disposed, an antenna signal can be radiated to free space only by using the decoupling assembly. In addition, because the decoupling assembly has electrical anisotropy, a k surface of the antenna signal is parallel lines (shown by dashed lines in the figure) in a plane. Correspondingly, as shown in FIG. 2(*d*), virtual space corresponding to the decoupling assembly is a relatively narrow area. Because it is not equally difficult to radiate an antenna signal in all directions of a decoupling structure, antenna radiation patterns respectively corresponding to the first antenna and the second antenna are changed, to change an antenna radiation direction (an intersection part of the antenna radiation patterns), and improve isolation between antennas.

In conclusion, according to the antenna system provided in this embodiment, the decoupling assembly having the electrical anisotropy is disposed on the radiation surface of the antenna pair, and the antenna radiation directions of the antennas in the antenna pair are adjusted by using the decoupling assembly, thereby resolving a problem that a poor effect is achieved when coupling between antennas is reduced by using a slit because there are many electronic elements in a mobile terminal and the slit is easily affected by surrounding electronic elements; and the antenna radiation directions of the antennas are changed by using the decoupling assembly disposed on the radiation surface of the antenna pair, so that isolation between the antennas and antenna radiation efficiency are improved.

Figure 3:
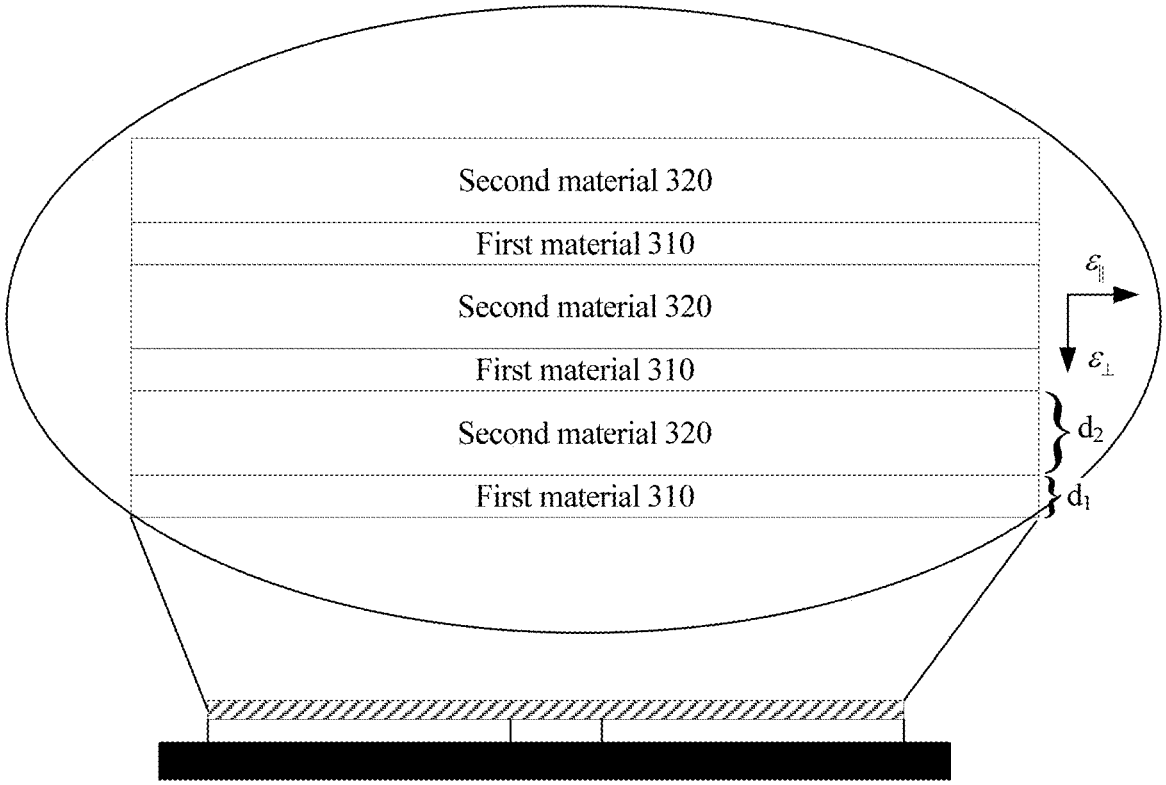
FIG. 3 is a schematic structural diagram of a decoupling assembly in an antenna system according to an embodiment of this application.

FIG. 3 is a schematic structural diagram of a decoupling assembly in an antenna system according to an embodiment of this application.

The decoupling assembly is in a laminated structure, the laminated structure is formed by alternately stacking at least two materials, and permittivities of the at least two materials are different. It should be noted that this embodiment is schematically described only by using an example in which the laminated structure includes two materials. In another possible implementation, the laminated structure may be formed by alternately stacking three or more materials. This is not limited in this embodiment.

As shown in FIG. 3, the laminated structure is formed by alternately stacking a first material 310 and a second material 320, and permittivities of the first material 310 and the second material 320 are different. It should be noted that this embodiment is described by using an example in which the laminated structure is a planar laminated structure. In another possible implementation, the laminated structure may alternatively be an arc laminated structure. This is not limited in this embodiment of this application.

As shown in FIG. 3, a thickness of the first material 310 is $d_1$, and a thickness of the second material 320 is $d_2$, where $(d1+d2)<\lambda/2$, and $\lambda$ is a wavelength of an operating frequency of an antenna pair. Preferably, $d_1+d_2$ meets a deep subwavelength, so that a better antenna decoupling effect is achieved.

For example, when the operating frequency of the antenna pair is 3 GHz, a sum of thicknesses of the first material and the second material needs to be less than 50 mm. Preferably, the sum of the thicknesses of the first material and the second material needs to be less than 10 mm.

According to an effective medium theory, in the laminated structure shown in FIG. 3, an effective permittivity in a direction perpendicular to the laminated structure is $\varepsilon_{\perp}=(\varepsilon_1\varepsilon_2)/(f\varepsilon_2+(1-f)\varepsilon_1)$, and an effective permittivity in a direction parallel to the laminated structure is $\varepsilon_{81}=f\varepsilon_1+(1-f)\varepsilon_2$. The direction perpendicular to the laminated structure is a direction perpendicular to a contact surface between the first material and the second material, the direction parallel to the laminated structure is a direction parallel to the contact surface between the first material and the second material, $\varepsilon_1$ is a permittivity of the first material, $\varepsilon_2$ is a permittivity of the second material, f is a duty cycle of the first material, and $f=d_1/(d_1+d_2)$. When the permittivity of the first material is greater than the permittivity of the second material, the effective permittivity of the laminated structure in a parallel direction is greater than the effective permittivity of the laminated structure in a perpendicular direction. Correspondingly, in the laminated structure, it is less difficult to radiate an antenna signal in the parallel direction than in the perpendicular direction. Therefore, an antenna can be controlled by using the laminated structure to radiate the antenna signal in a direction with a relatively low radiation difficulty, so that an antenna radiation direction is changed.

To achieve a better antenna isolation effect, in the laminated structure shown in FIG. 3, the first material 310 is a good-conductor material, and the second material 320 is a dielectric material, where $|\varepsilon_1|>>|\varepsilon_2|$.

On a microwave frequency band, the permittivity of the first material tends to infinity, and the permittivity of the second material is a constant value. Therefore, the effective permittivity $\varepsilon_{\perp}$ of the laminated structure in the perpendicular direction tends to a constant value, and the effective permittivity $\varepsilon_{\parallel}$ of the laminated structure in the parallel direction tends to infinity; in other words, $|\varepsilon_{\perp}|<<|\varepsilon_{\parallel}|$, and significant electrical anisotropy is presented.

In a possible implementation, the first material may be a metal film, and a material of the metal film may be iron, silver, aluminum, or the like. The second material may be a dielectric sheet, and a material of the dielectric sheet may be plastic. It should be noted that on the microwave frequency band, when the duty cycle of the first material is small and the permittivity of the second material is close to a permittivity of air (the permittivity of air is 1), the laminated structure has relatively small impact on a return loss and antenna coupling, and this facilitates antenna design.

In conclusion, in this embodiment, the laminated structure is formed by alternately stacking the at least two materials with the different permittivities, and the laminated structure is made into the decoupling assembly to decouple the antenna pair, thereby resolving a problem that a poor effect is achieved when coupling between antennas is reduced by using a slit because there are many electronic elements in a mobile terminal and the slit is easily affected by surrounding electronic elements; and antenna radiation directions of the antennas are changed by using the decoupling assembly disposed on a radiation surface of the antenna pair, so that isolation between the antennas and antenna radiation efficiency are improved.

Figure 4:
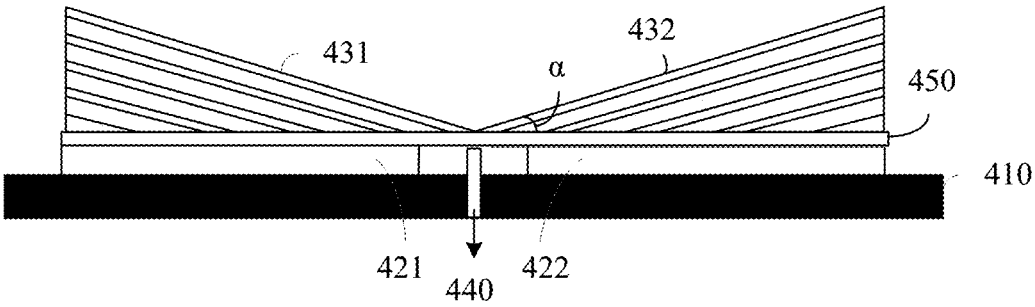
FIG. 4 is a schematic diagram of an antenna system according to another embodiment of this application.

FIG. 4 is a schematic diagram of an antenna system according to another embodiment of this application. The antenna system includes a ground plate 410, a first antenna 421, a second antenna 422, and a first decoupling subassembly 431 and a second decoupling subassembly 432 that are symmetrically disposed.

The first decoupling subassembly 431 is disposed on a radiation surface of the first antenna 421, and the second decoupling subassembly 432 is disposed on a radiation surface of the second antenna 422.

Laminated structures of the first decoupling subassembly 431 and the second decoupling subassembly 432 are the same, and each are formed by alternately stacking two materials, and an effective permittivity of the laminated structure in a parallel direction is far greater than an effective permittivity of the laminated structure in a perpendicular direction. In addition, an included angle $\alpha$ is formed between the laminated structure and the ground plate 410. Antenna radiation directions of the first antenna 421 and the second antenna 422 can be further adjusted by changing a magnitude of the included angle $\alpha$.

The included angle $\alpha$ between the laminated structure and the ground plate 410 usually ranges from 10° to 60°. As the included angle $\alpha$ changes, a decoupling effect of a decoupling assembly also changes: Smaller a leads to higher isolation between the first antenna and the second antenna and a better decoupling effect. However, when a is smaller, an antenna return loss increases. When a is larger, a height of the laminated structure needs to correspondingly increase.

It should be noted that in this embodiment, when a distance between the antennas meets a deep subwavelength, the included angle $\alpha$ between the laminated structure and the ground plate ranges from 10° to 60°. Based on a concept of this application, a person skilled in the art may figure out that a range of the included angle $\alpha$ is expanded by increasing the distance between the antennas. For example, when the distance between the antennas is 0.2 times a wavelength, the included angle $\alpha$ may range from 10° to 70°. This is not limited in this application.

As shown in FIG. 4, a part of the first antenna 421 and the second antenna 422 is disposed on the ground plate 410. When the first antenna 421 and the second antenna 422 work, electromagnetic waves radiated from the first antenna 421 and the second antenna 422 scatter in the ground plate 410 and cause interference to each other. To reduce interference caused by the scattered electromagnetic waves to the antennas, as shown in FIG. 4, a metallic wire 440 penetrating the ground plate 410 is disposed between the first antenna 421 and the second antenna 422. The metallic wire 440 is in contact with neither the first antenna 421 nor the second antenna 422. The interference caused by the scattered electromagnetic waves to the antennas can be reduced by using the metallic wire 440, so that radiation efficiency of the antenna system is further improved.

In addition, when the laminated structure used by the first decoupling subassembly 431 (or 432) includes a conductor material, if the first decoupling subassembly 431 (or 432) is in direct contact with the first antenna 421 (or the second antenna 422), a part of a feeding current flowing through the first antenna 421 (or 422) flows into the first decoupling subassembly 431 (or 432). Consequently, a short circuit occurs, and radiation of the first antenna 421 (or 422) is affected. Therefore, as shown in FIG. 4, an insulation layer 450 is further disposed between the first decoupling subassembly 431 (or 432) and the first antenna 421 (or 422), to avoid the short circuit between the decoupling assembly and the antenna.

Figure 5:
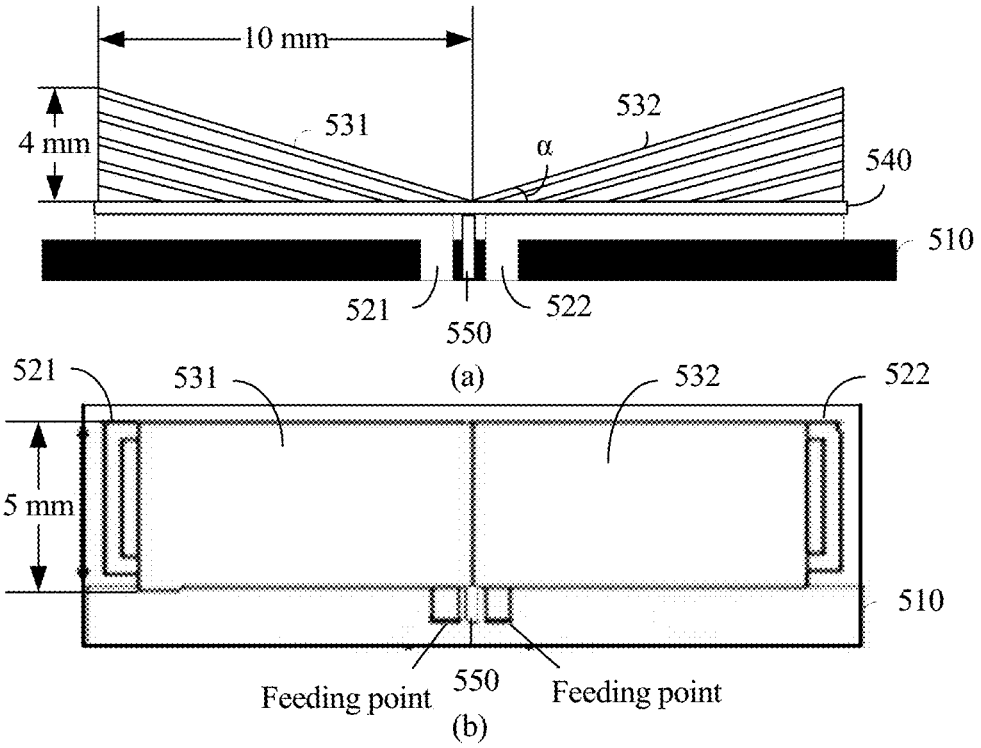
FIG. 5 is a schematic structural diagram of an antenna system according to still another embodiment of this application.

FIG. 5 is a schematic structural diagram of an antenna system according to still another embodiment of this application. The antenna system includes a ground plate 510, a first antenna 521, a second antenna 522, and a first decoupling subassembly 531 and a second decoupling subassembly 532 that are symmetrically disposed.

The ground plate 510 includes a substrate and a ground floor, the first antenna 521 and the second antenna 522 are disposed on a first surface of the substrate, and the ground floor is laid on a second surface of the substrate. A dielectric material (whose relative permittivity is 4.4) of an FR4 specification that is 1 mm in thickness is used for the substrate.

As shown in FIG. 5(*a*) and FIG. 5(*b*), the first decoupling subassembly 531 and the second decoupling subassembly 532 each are in a triangular prism laminated structure, and dimensions of the first decoupling subassembly 531 and the second decoupling subassembly 532 each are 10 mm×5 mm×4 mm. In other words, a dimension of a decoupling assembly including the first decoupling subassembly 531 and the second decoupling subassembly is 20 mm×5 mm×4 mm. It should be noted that this embodiment is schematically described only by using an example in which the first decoupling subassembly and the second decoupling subassembly are in the triangular prism laminated structure. In another possible implementation, the first decoupling subassembly and the second decoupling subassembly may alternatively be made into an n (n≥4) prism laminated structure, a fan-shaped column laminated structure, a cylinder laminated structure, a semi-cylinder laminated structure, or a laminated structure in any other shape. This is not limited in this application.

As shown in FIG. 5(*a*), the triangular prism laminated structure is formed by alternately stacking a first material and a second material. The first material is a metal film, the second material is a dielectric sheet, and an included angle α between the triangular prism laminated structure and the ground plate 510 is 22.6°. A permittivity of the metal film tends to infinity, and a permittivity of the dielectric sheet is close to a permittivity of air.

In a possible implementation, the metal film may be an aluminum film, and the dielectric sheet may be a ROHACELL 71HF foam sheet (whose relative permittivity is approximately 1.1) that is 1 mm in thickness. An effective permittivity of the triangular prism laminated structure in a parallel direction tends to infinity, and an effective permittivity of the triangular prism laminated structure in a perpendicular direction tends to 1. Therefore, in the triangular prism laminated structure, it is far less difficult to perform radiation in the parallel direction (a direction parallel to the laminated structure) than to perform radiation in the perpendicular direction (a direction perpendicular to the laminated structure).

To prevent a feeding current from flowing into the decoupling assembly, as shown in FIG. 5(*a*), an insulation layer 540 is disposed between the decoupling assembly and an antenna pair. In a possible manner, the insulation layer 540 may be a foam layer that is 0.5 mm in thickness.

In addition, to reduce impact exerted on the first antenna 521 and the second antenna 522 by scattered electromagnetic waves in the ground plate 510, as shown in FIG. 5(*a*) and FIG. 5(*b*), a metallic wire 550 is further disposed between the first antenna 521 and the second antenna 522, and the metallic wire 550 penetrates the ground plate 510.

When the antenna pair is decoupled by using the decoupling assembly in the antenna system shown in FIG. 5, the decoupling assembly does not damage matching of a single antenna, so that an antenna return loss does not become large, and bandwidth does not become narrow. In addition, decoupling assemblies of a same dimension can be applied to different types of antenna pairs on different operating frequency bands. A decoupling effect achieved when a same decoupling assembly is applied to different types of antennas at different operating frequencies is described below with reference to simulated data.

Figure 6:
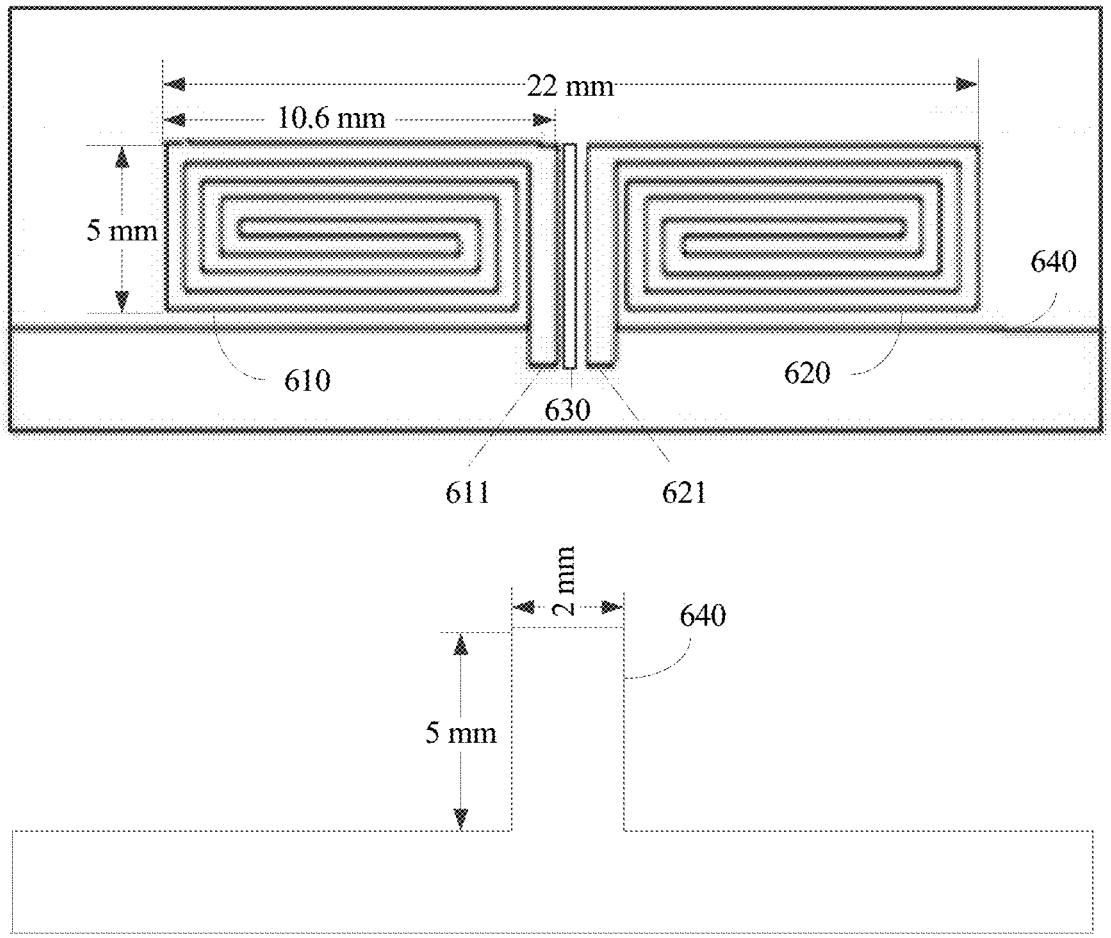
FIG. 6 is a schematic structural diagram of an antenna pair according to an embodiment of this application.

FIG. 6 is a schematic structural diagram of an antenna pair according to an embodiment of this application. This embodiment is described by using an example in which the antenna pair includes the first antenna and the second antenna shown in FIG. 5.

As shown in FIG. 6, the antenna pair is a helical monopole antenna pair printed on a surface of a ground plate, and an operating frequency of the helical monopole antenna pair ranges from 4.55 GHz to 4.75 GHz.

A dimension of the helical monopole antenna pair is 22 mm×5 mm, dimensions of a first antenna 610 and a second antenna 620 each are 10.6 mm×5 mm, and a distance between a first antenna feeding point 611 and a second antenna feeding point 621 is 0.8 mm. Specifically, in the first antenna 610 (or the second antenna 620) shown in FIG. 6, a first helical structure near the feeding point is 0.75 mm in width, and another helical structure is 0.5 mm in width.

Because the operating frequency of the helical monopole antenna pair ranges from 4.55 GHz to 4.75 GHz, the distance between the first antenna feeding point 611 and the second antenna feeding point 621 is 0.01 wavelength of a center frequency (4.65 GHz), and meets a deep subwavelength requirement.

A metallic wire 630 is further disposed between the first antenna 610 and the second antenna 620. A dimension of the metallic wire 630 is: length=6 mm, width=0.4 mm, and height=1 mm. The metallic wire 630 is configured to reduce impact exerted on the first antenna 610 and the second antenna 620 by electromagnetic waves reflected by the ground plate. In addition, a metallic plate 640 that is 2 mm in width and 5 mm in length is disposed directly below a center point between the first antenna 610 and the second antenna 620 to assist with feeding, to optimize antenna impedance matching.

Figure 7:
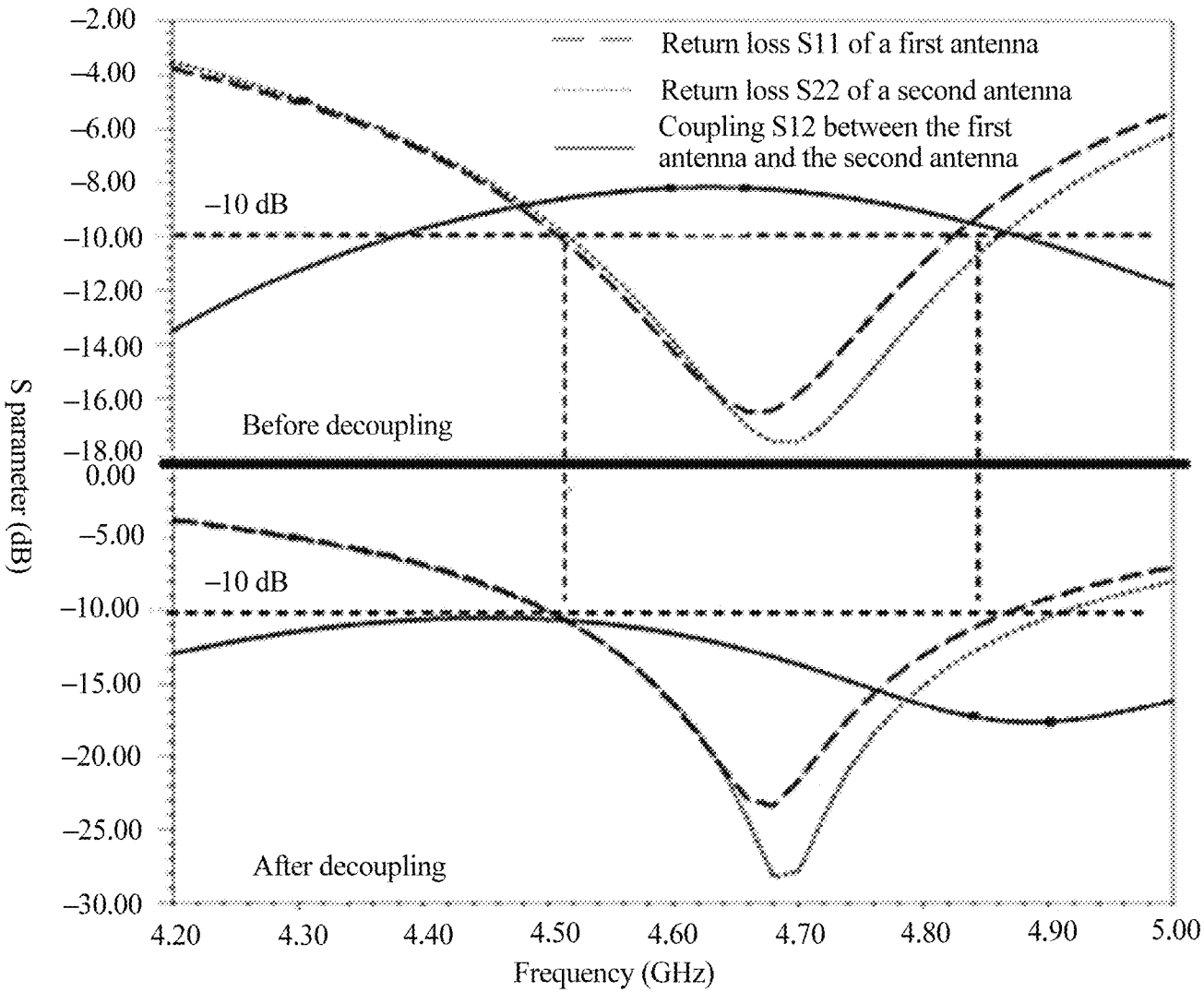
FIG. 7 is a line graph of a return loss and antenna coupling that are of the antenna pair shown in FIG. 6 before and after a decoupling assembly is disposed.

As shown in FIG. 7, after the antenna pair shown in FIG. 6 is excited, if decoupling is performed without using the decoupling assembly shown in FIG. 5, near the operating frequency, coupling between the first antenna and the second antenna is greater than −10 dB, and is −8 dB at maximum, and therefore the antenna coupling is severe. If decoupling is performed by using the decoupling assembly shown in FIG. 5, coupling between the first antenna and the second antenna is less than −10 dB near the operating frequency, and therefore the antenna coupling is relatively small, so that 10 dB isolation is implemented when a distance between the antennas is 0.01 wavelength, and antenna efficiency of a helical monopole antenna pair is increased by 15%. In addition, before and after decoupling is performed by using the decoupling assembly shown in FIG. 5, return losses of the first antenna and the second antenna do not change significantly, and bandwidth of the first antenna and bandwidth of the second antenna are not significantly reduced.

Apparently, when the decoupling assembly shown in FIG. 5 is used, the coupling of the helical monopole antenna pair at 4.55 GHz to 4.75 GHz can be significantly reduced, isolation between the antennas can be improved, and finally radiation efficiency of the antenna pair can be improved.

Figure 8:
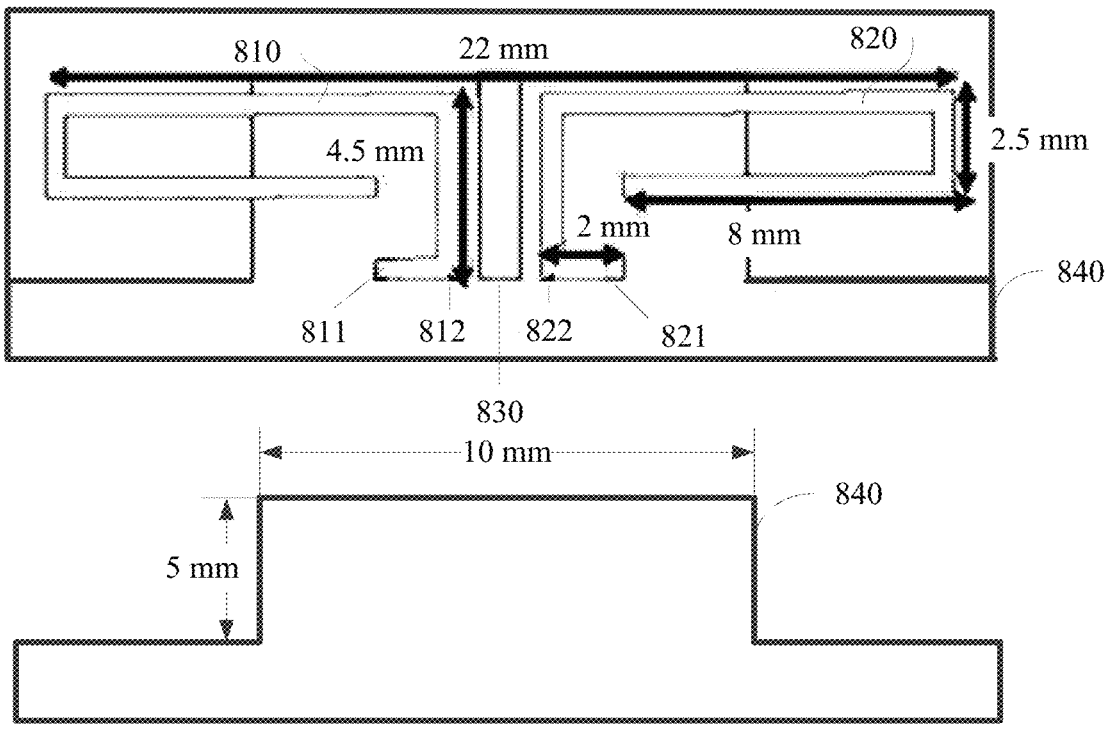
FIG. 8 is a schematic structural diagram of an antenna pair according to another embodiment of this application.

FIG. 8 is a schematic structural diagram of an antenna pair according to another embodiment of this application. This embodiment is described by using an example in which the antenna pair includes the first antenna and the second antenna shown in FIG. 5.

As shown in FIG. 8, the antenna pair is a PIFA antenna pair printed on a surface of a ground plate, and an operating frequency of the PIFA antenna pair ranges from 2.3 GHz to 2.4 GHz.

A dimension of the PIFA antenna pair is 22 mm×5 mm, dimensions of a first antenna 810 and a second antenna 820 each are 10 mm×5 mm, a distance between a first antenna feeding point 811 and a second antenna feeding point 821 is 5 mm, and a distance between a first antenna ground point 812 and a second antenna ground point 822 is 2 mm. Specifically, an antenna metallic wire of the first antenna 810 (or the second antenna 820) shown in FIG. 8 is 0.5 mm in width.

Because the operating frequency of the PIFA antenna pair ranges from 2.3 GHz to 2.4 GHz, the distance between the first antenna feeding point 811 and the second antenna feeding point 821 is 0.039 wavelength of a center frequency (2.35 GHz), and meets a deep subwavelength requirement; and the distance between the first antenna ground point 812 and the second antenna ground point 822 is 0.016 wavelength of the center frequency (2.35 GHz), and meets the deep subwavelength requirement.

A metallic wire 830 is further disposed between the first antenna 810 and the second antenna 820. A dimension of the metallic wire 830 is: length=5 mm, width=1 mm, and height=1.5 mm. The metallic wire 830 is configured to reduce impact exerted on the first antenna 810 and the second antenna 820 by scattered electromagnetic waves in the ground plate. In addition, a metallic plate 840 that is 10 mm in width and 5 mm in length is disposed directly below a center point between the first antenna 810 and the second antenna 820 to assist with feeding, to optimize antenna impedance matching.

Figure 9:
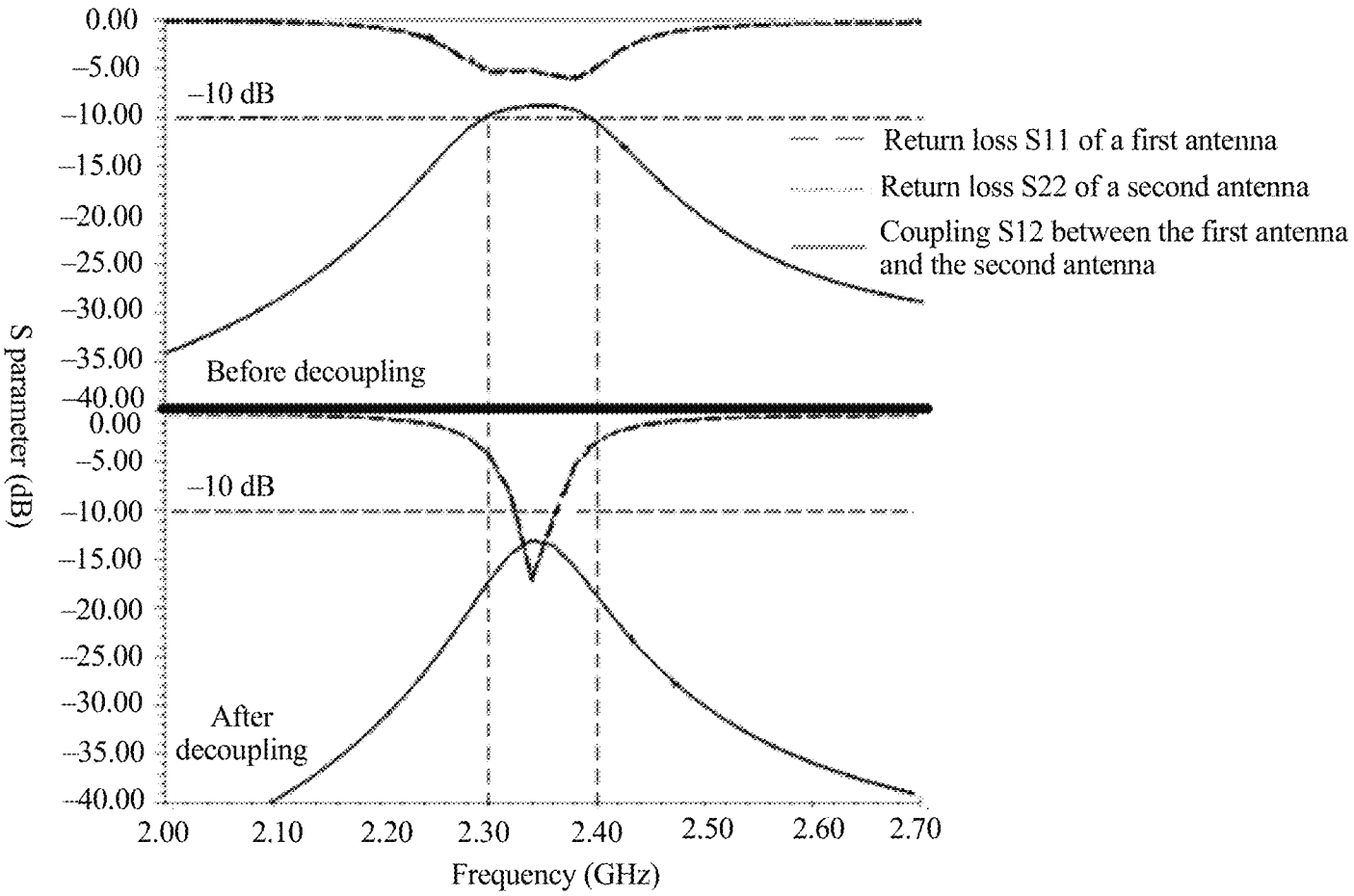
FIG. 9 is a line graph of a return loss and antenna coupling that are of the antenna pair shown in FIG. 8 before and after a decoupling assembly is disposed.

As shown in FIG. 9, after the antenna pair shown in FIG. 8 is excited, if decoupling is performed without using the decoupling assembly shown in FIG. 5, coupling between the first antenna and the second antenna is greater than −10 dB near the operating frequency, and therefore the antenna coupling is severe, and an antenna return loss is also affected and is only −5 dB. If decoupling is performed by using the decoupling assembly shown in FIG. 5, coupling between the first antenna and the second antenna is less than −10 dB near the operating frequency, and therefore the antenna coupling is relatively small, so that 10 dB isolation is implemented when a distance between the antennas is 0.016 wavelength, and an antenna return loss is reduced to −10 dB after decoupling is performed by using the decoupling assembly shown in FIG. 5.

Apparently, when the decoupling assembly shown in FIG. 5 is used, the coupling of the PIFA antenna pair at 2.3 GHz to 2.4 GHz can be significantly reduced, isolation between the antennas can be improved, and finally radiation efficiency of the antenna pair can be improved.

Figure 10:
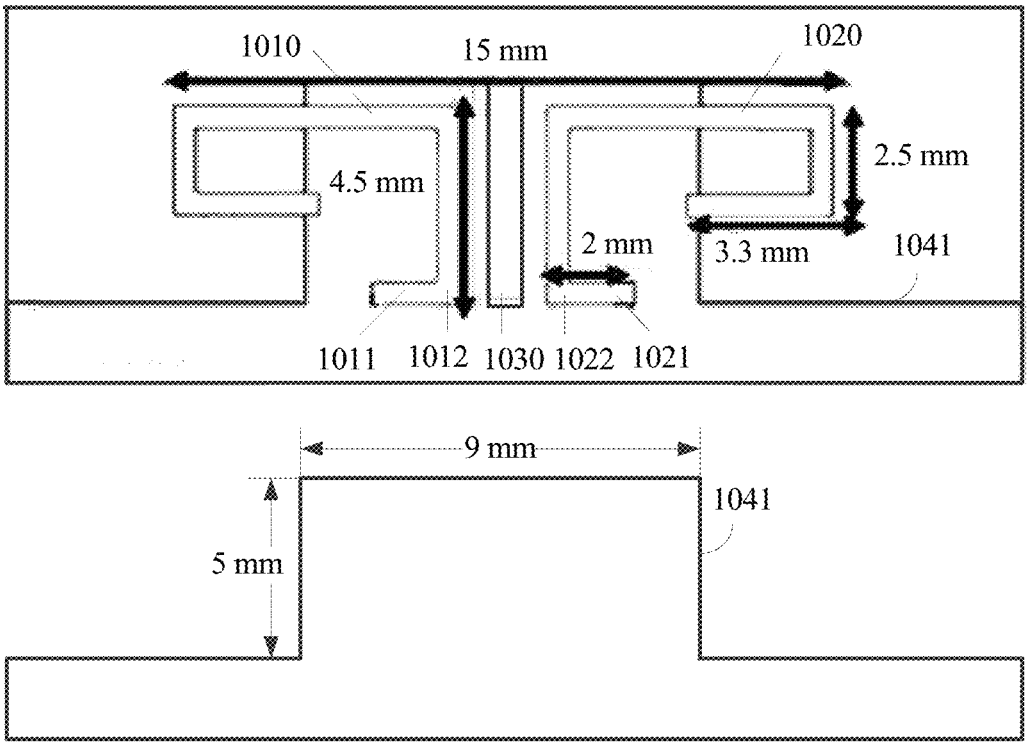
FIG. 10 is a schematic structural diagram of an antenna pair according to still another embodiment of this application.

FIG. 10 is a schematic structural diagram of an antenna pair according to still another embodiment of this application. This embodiment is described by using an example in which the antenna pair includes the first antenna and the second antenna shown in FIG. 5.

As shown in FIG. 10, the antenna pair is a PIFA antenna pair printed on a surface of a ground plate, and an operating frequency of the PIFA antenna pair ranges from 3.4 GHz to 3.6 GHz.

A dimension of the PIFA antenna pair is 15 mm×5 mm, dimensions of a first antenna 1010 and a second antenna 1020 each are 6.5 mm×5 mm, a distance between a first antenna feeding point 1011 and a second antenna feeding point 1021 is 5 mm, and a distance between a first antenna ground point 1012 and a second antenna ground point 1022 is 2 mm. Specifically, an antenna metallic wire of the first antenna 1010 (or the second antenna 1020) shown in FIG. 8 is 0.5 mm in width.

Because the operating frequency of the PIFA antenna pair ranges from 3.4 GHz to 3.6 GHz, the distance between the first antenna feeding point 1011 and the second antenna feeding point 1021 is 0.058 wavelength of a center frequency (3.5 GHz), and meets a deep subwavelength requirement; and the distance between the first antenna ground point 1012 and the second antenna ground point 1022 is 0.023 wavelength of the center frequency (3.5 GHz), and meets the deep subwavelength requirement.

A metallic wire 1030 is further disposed between the first antenna 1010 and the second antenna 1020. A dimension of the metallic wire 1030 is: length=5 mm, width=1 mm, and height=1.5 mm. The metallic wire 1030 is configured to reduce impact exerted on the first antenna 1010 and the second antenna 1020 by scattered electromagnetic waves in the ground plate. In addition, a metallic plate 1040 that is 9 mm in width and 5 mm in length is disposed directly below a center point between the first antenna 1010 and the second antenna 1020 to assist with feeding, to optimize antenna impedance matching.

Figure 11:
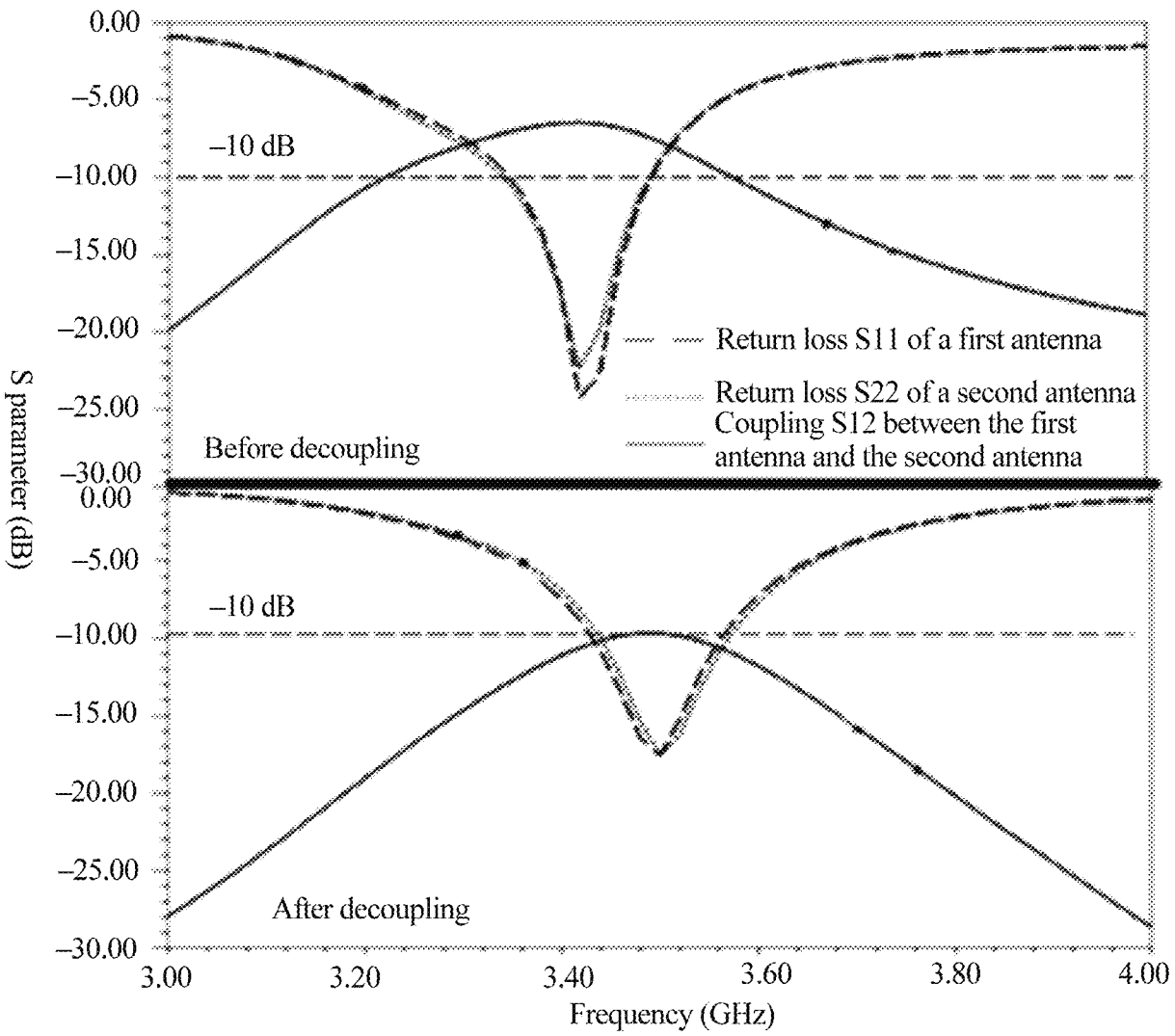
FIG. 11 is a line graph of a return loss and antenna coupling that are of the antenna pair shown in FIG. 10 before and after a decoupling assembly is disposed.

As shown in FIG. 11, after the antenna pair shown in FIG. 10 is excited, if decoupling is performed without using the decoupling assembly shown in FIG. 5, coupling between the first antenna and the second antenna is greater than −10 dB near the operating frequency, and therefore the antenna coupling is severe. If decoupling is performed by using the decoupling assembly shown in FIG. 5, coupling between the first antenna and the second antenna is less than −10 dB near the operating frequency, and therefore the antenna coupling is relatively small, so that 10 dB isolation is implemented when a distance between the antennas is 0.023 wavelength, and an antenna return loss is less than −10 dB after decoupling is performed by using the decoupling assembly shown in FIG. 5.

Apparently, when the decoupling assembly shown in FIG. 5 is used, the coupling of the PIFA antenna pair at 3.4 GHz to 3.6 GHz can be significantly reduced, isolation between the antennas can be improved, and finally radiation efficiency of the antenna pair can be improved.

In conclusion, in the antenna system provided in the embodiments of this application, there is no need to dispose a slit on the ground plate, thereby ensuring integrity and strength of the ground plate, so that the antenna system is applicable to an actual product. In addition, a material used in the decoupling assembly has small dispersion, is applicable to broadband decoupling, does not intrinsically damage matching of a single antenna, does not affect bandwidth, and has good applicability, so that there is no need to redesign the decoupling assembly for different antennas on different frequency bands.

Figure 12:
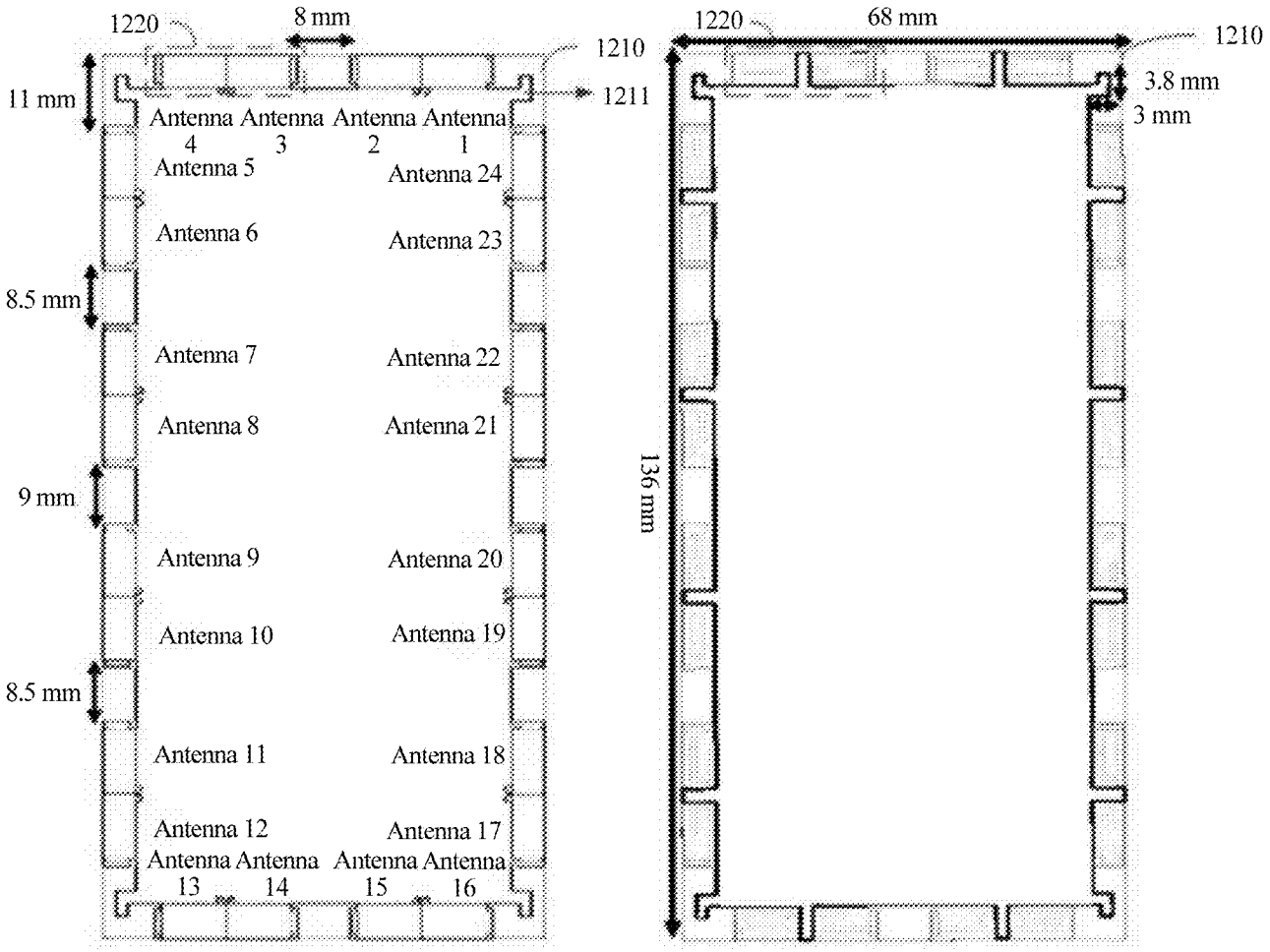
FIG. 12 is a schematic structural diagram of an antenna system according to yet another embodiment of this application.

FIG. 12 is a schematic structural diagram of an antenna system according to yet another embodiment of this application. This embodiment is described by using an example in which 12 antenna pairs shown in FIG. 6 are disposed in the antenna system and the decoupling assembly shown in FIG. 5 is disposed on a radiation surface of each antenna pair.

As shown in FIG. 12, a dimension of a ground plate 1210 is 136 mm×68 mm, and 12 helical monopole antenna pairs 1220 are disposed at an edge location of the ground plate 1210.

It should be noted that four corners of the ground plate 1210 each have an L-shaped structure 1211. The L-shaped structure 1211 is configured to reduce coupling between two adjacent antenna pairs at the four corners. A line width of the L-shaped structure 1211 is 2 mm, and the L-shaped structure 1211 is 3.8 mm and 3 mm respectively in length and in width.

Because a dimension of the helical monopole antenna pair is 22 mm×5 mm, two helical monopole antenna pairs 1220 are disposed on each of an upper edge and a lower edge of the ground plate 1210 shown in FIG. 12, and four helical monopole antenna pairs 1220 are disposed on each of a left edge and a right edge of the ground plate 1210.

In addition, a distance between the helical monopole antenna pairs 1220 is greater than 8 mm, to reduce coupling between adjacent helical monopole antenna pairs 1220. Specifically, as shown in FIG. 12, an antenna 1 to an antenna 9 are used as examples. A distance between the antenna 2 and the antenna 3 is 8 mm, a distance between the antenna 5 and the upper edge of the ground plate is 11 mm, a distance between the antenna 6 and the antenna 7 is 8.5 mm, and a distance between the antenna 8 and the antenna 9 is 9 mm. Distribution of other antennas is similar to that of the foregoing antennas. Details are not described herein.

Figure 13:
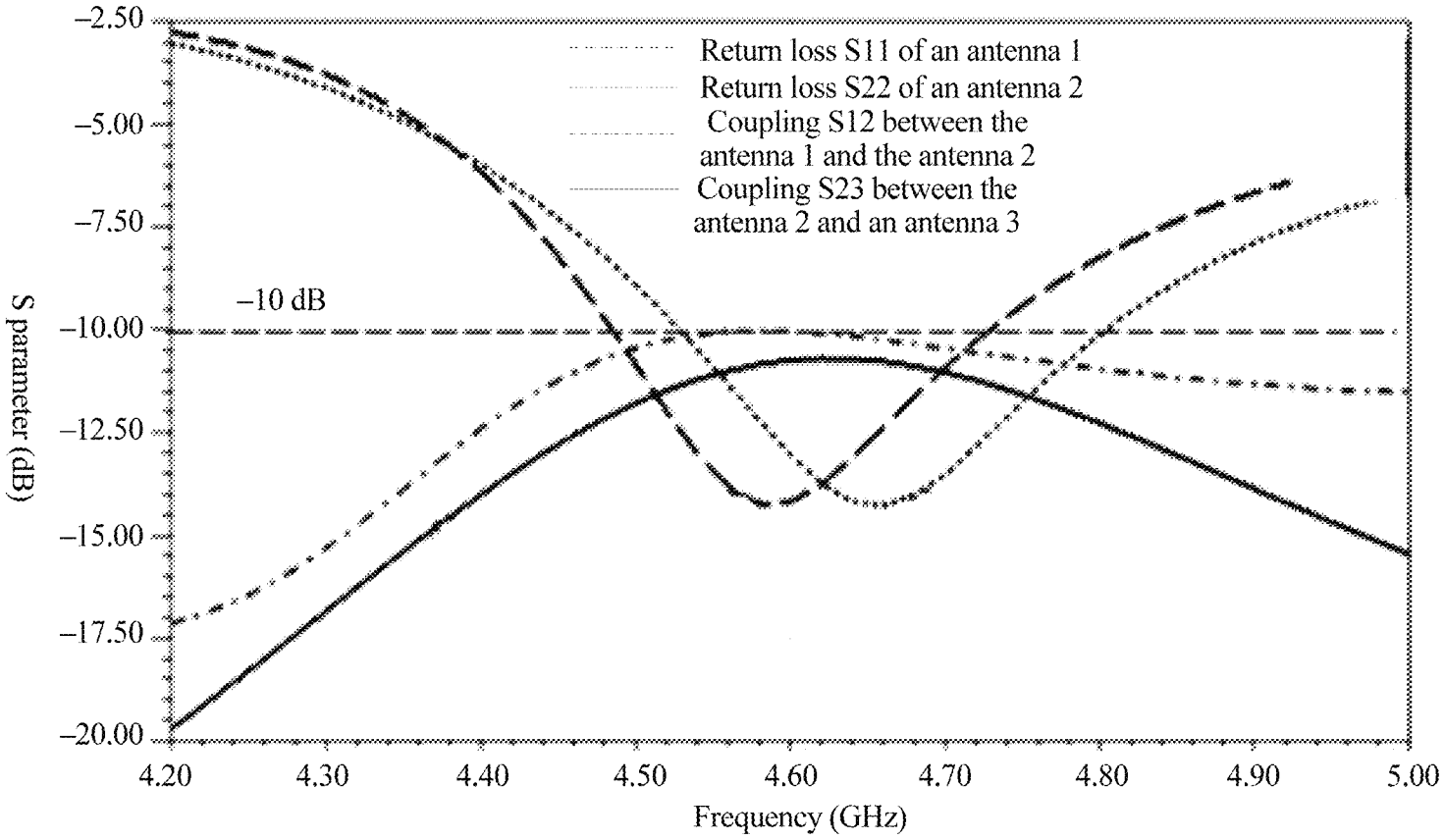
FIG. 13 to FIG. 15 are line graphs of a return loss and antenna coupling that are of an antenna pair in the antenna system shown in FIG. 12.
Figure 14:
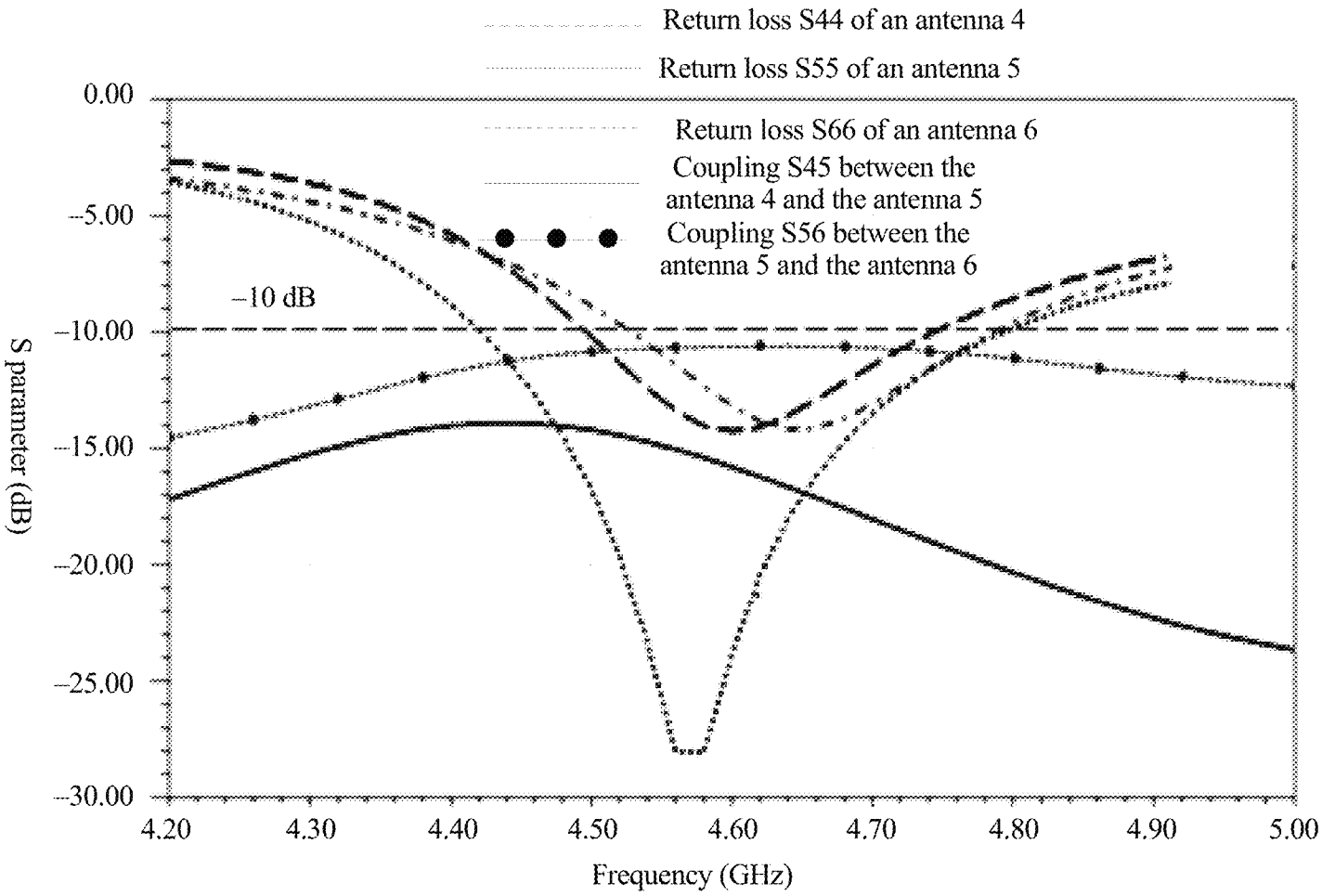
Figure 15:
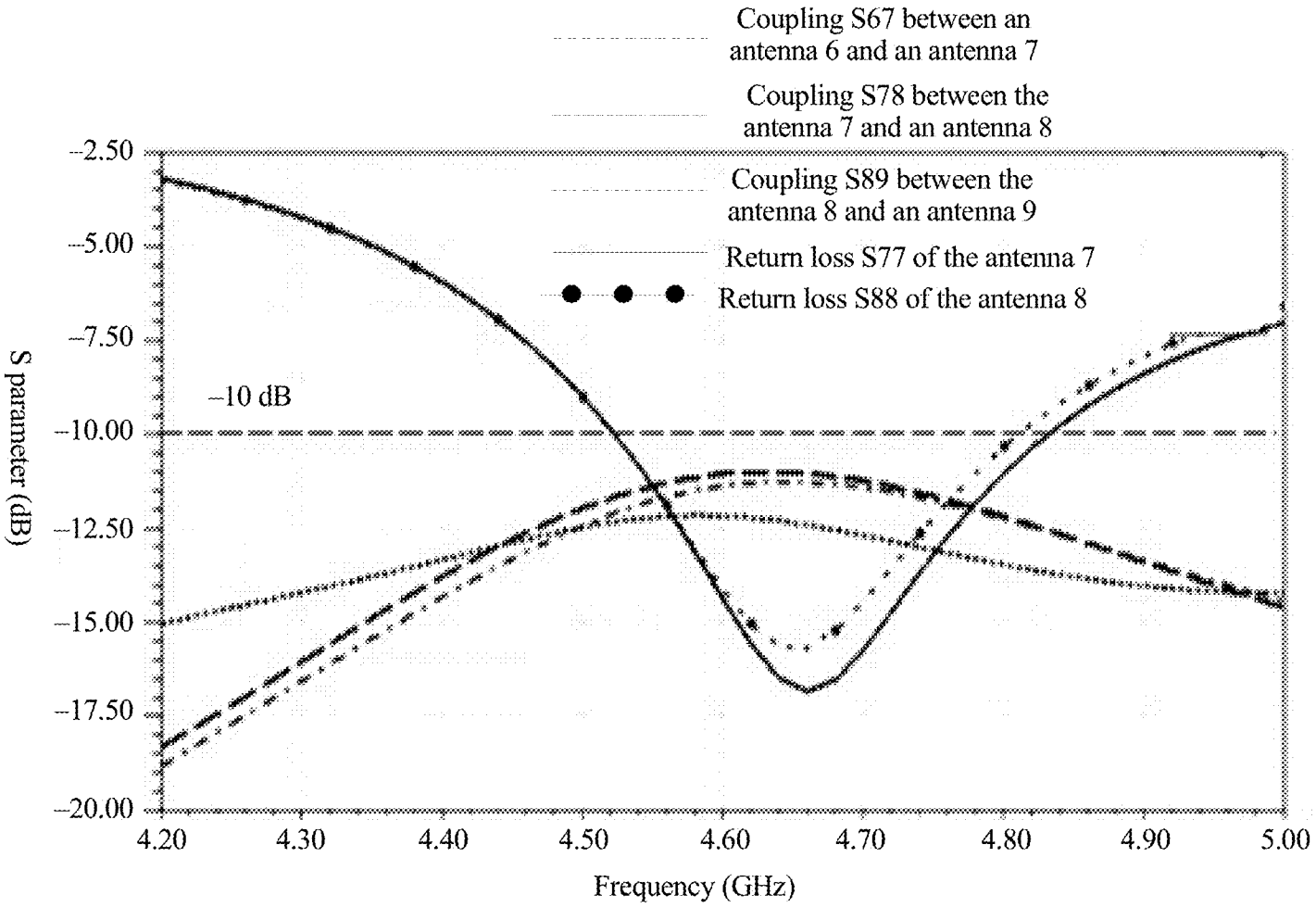

As shown in FIG. 13, after the antenna pair in the antenna system shown in FIG. 12 is excited, and decoupling is performed by using the decoupling assembly shown in FIG. 5, return losses of the four antennas located on the upper edge of the ground plate each are less than −10 dB, and coupling is less than −10 dB (on the lower edge and the upper edge). As shown in FIG. 14, return losses of antennas located at the four top corners of the ground plate each are less than −10 dB, and coupling is less than −10 dB. As shown in FIG. 15, return losses of antennas located on the left edge of the ground plate each are less than −10 dB, and coupling is less than −10 dB.

It should be noted that a person skilled in the art may dispose four, six, or eight MIMO antenna pairs on a peripheral side of the ground plate based on a concept of this application. A quantity of antenna pairs on the ground plate is not limited in this embodiment.

In conclusion, in the antenna system provided in this embodiment, for a terminal of a relatively small size, a plurality of antenna pairs are disposed on the peripheral side of the ground plate at intervals, and the decoupling assembly is disposed on a radiation surface of each antenna pair, so that isolation between the antennas in the antenna pair and isolation between the antenna pairs are improved, and efficiency of a MIMO antenna in the small-sized terminal is improved.

The sequence numbers of the foregoing embodiments of this application are merely for illustrative purposes, and are not intended to indicate priorities of the embodiments.

What is claimed is:

1. An antenna system, wherein the antenna system comprises:

a ground plate, at least one antenna pair disposed on the ground plate, and a decoupling assembly disposed on a radiation surface of the antenna pair, wherein the antenna pair comprises a first antenna and a second antenna;

the decoupling assembly comprises a contiguous layer that is in contact with both the first antenna and the second antenna;

the decoupling assembly has electrical anisotropy, and the electrical anisotropy indicates that an effective permittivity of the decoupling assembly has different real and imaginary components in different directions;

the decoupling assembly is configured to adjust antenna radiation directions of the first antenna and the second antenna; and isolation between the first antenna and the second antenna after adjustment is greater than isolation between the first antenna and the second antenna before adjustment.

2. The antenna system according to claim 1, wherein the decoupling assembly is in a laminated structure;

the laminated structure is formed by alternately stacking at least two materials, and permittivities of the at least two materials are different; and a sum of thicknesses of the at least two materials is less than a half wavelength corresponding to an operating frequency of the antenna pair, wherein $|\varepsilon_\perp|<|\varepsilon_\parallel|$, $\varepsilon_\perp$ is an effective permittivity of the laminated structure in a perpendicular direction, $\varepsilon_\parallel$ is an effective permittivity of the laminated structure in a parallel direction, the parallel direction is a direction parallel to the laminated structure, and the perpendicular direction is a direction perpendicular to the laminated structure.

3. The antenna system according to claim 2, wherein the laminated structure is formed by alternately stacking a first material and a second material;

the first material is a good-conductor material; and the second material is a dielectric material, wherein $|\varepsilon_1|?|\varepsilon_2|$ and $|\varepsilon_\perp|=|\varepsilon_\parallel|$, $\varepsilon_1$ is a permittivity of the first material, and $\varepsilon_2$ is a permittivity of the second material.

4. The antenna system according to claim 2, wherein the decoupling assembly further comprises two decoupling subassemblies that are symmetrically disposed, and the two decoupling subassemblies are respectively disposed on radiation surfaces of the first antenna and the second antenna; and an included angle $\alpha$ is formed between the laminated structure and the ground plate, wherein $10°\leq\alpha\leq60°$.

5. The antenna system according to claim 4, wherein the decoupling subassembly is in a triangular prism laminated structure;

a dimension of the triangular prism laminated structure is 10 mm×5 mm×4 mm;

the triangular prism laminated structure is formed by alternately stacking a metal film and a dielectric sheet;

an included angle $\alpha$ between the triangular prism laminated structure and the ground plate is 22.6°; and the dielectric sheet in the triangular prism laminated structure is 1 mm in thickness, and a relative permittivity of the dielectric sheet is 1.1.

6. The antenna system according to claim 5, wherein the antenna pair is a helical monopole antenna pair, and the helical monopole antenna pair is printed on a surface of the ground plate;

a dimension of the helical monopole antenna pair is 22 mm×5 mm;

dimensions of the first antenna and the second antenna in the helical monopole antenna pair each are 10.6 mm×5 mm, and a distance between a first antenna feeding point and a second antenna feeding point is 0.8 mm; and an operating frequency of the helical monopole antenna pair ranges from 4.55 GHz to 4.75 GHz.

7. The antenna system according to claim 6, wherein a dimension of the ground plate is 136 mm×68 mm, and 12 helical monopole antenna pairs are disposed on an edge of the ground plate;

two helical monopole antenna pairs are disposed on each of an upper edge and a lower edge of the ground plate;

four helical monopole antenna pairs are disposed on each of a left edge and a right edge of the ground plate; and a distance between the helical monopole antenna pairs is greater than 8 mm.

8. The antenna system according to claim 5, wherein the antenna pair is a planar inverted F antenna, PIFA antenna pair, and the PIFA antenna pair is printed on a surface of the ground plate;

a dimension of the PIFA antenna pair is 22 mm×5 mm;

dimensions of the first antenna and the second antenna in the PIFA antenna pair each are 10 mm×5 mm, a distance between a first antenna feeding point and a second antenna feeding point is 5 mm, and a distance between a first antenna ground point and a second antenna ground point is 2 mm; and an operating frequency of the PIFA antenna pair ranges from 2.3 GHz to 2.4 GHz.

9. The antenna system according to claim 5, wherein the antenna pair is a planar inverted F antenna PIFA antenna pair, and the PIFA antenna pair is printed on a surface of the ground plate;

a dimension of the PIFA antenna pair is 15 mm×5 mm;

dimensions of the first antenna and the second antenna in the PIFA antenna pair each are 6.5 mm×5 mm, a distance between a first antenna feeding point and a second antenna feeding point is 5 mm, and a distance between a first antenna ground point and a second antenna ground point is 2 mm; and an operating frequency of the PIFA antenna pair ranges from 3.4 GHz to 3.6 GHz.

10. The antenna system according to claim 1, wherein a metallic wire is disposed between the first antenna and the second antenna, the metallic wire penetrates the ground plate, and the metallic wire is used to reduce interference caused by a scattered electromagnetic wave in the ground plate to the first antenna and the second antenna.

11. The antenna system according to claim 1, wherein an insulation layer is disposed between the decoupling assembly and the antenna pair.

* * * * *